US005816120A

United States Patent [19]

Kilgore

[11] Patent Number: 5,816,120

[45] Date of Patent: Oct. 6, 1998

[54] SLIP JOINT ADJUSTABLE JAW PRY TOOL

[76] Inventor: Gary Hartman Kilgore, 239 Calumet Pl., San Antonio, Tex. 78209

[21] Appl. No.: 767,685

[22] Filed: Dec. 17, 1996

[51] Int. Cl.[6] ..... B25B 7/04

[52] U.S. Cl. ..... 81/414; 81/302

[58] Field of Search ..... 81/302, 414

[56] References Cited

U.S. PATENT DOCUMENTS 4,907,477 3/1990 Farber ..... 81/302

*Primary Examiner*—James G. Smith

[57] ABSTRACT

A slip joint adjustable jaw pry tool is a plier configured tool which has opposing jaws facing outboard. There are two levers, a first and a second lever, each of which include a jaw portion and a handle portion. There is a channel with intersecting arcuate grooves provided on the first lever, between the handle and jaw. The second lever is provided with a pivot center point and an arcuate protuberance concentric to the pivot center point, between the handle and jaw. The levers extend substantially parallel to each other. The range of dimensional movement of the jaws, relative to each other, is determined by adjusting the location of the pivot center point of the second lever, in the channel of the first lever. This is accomplished by disengaging the arcuate protuberance of the second lever, from a given arcuate groove of the first lever, moving the pivot center point of the second lever along the channel of the first lever, and engaging the arcuate protuberance in a different arcuate groove.

1 Claim, 3 Drawing Sheets

SLIP JOINT ADJUSTABLE JAW PRY TOOL

BACKGROUND OF THE INVENTION

Gripping and incremental dimensional modification are fundamental material forming and mechanical installation and repair activities. There are a wide array of tools available for this work. There are a great variety of pliers available, many general purpose and many special purpose. However, I have found that I frequently need to hold an object internally, such as, when grinding its' exterior. Or, bend it outward carefully, such as, the window opening of a truck door. Or, stretch it to fit over a fitting, such as, a radiator hose. Or pry it apart, such as when replacing a rear transmission mount. These are some of the more obvious examples of very common work activities for which this adjustable pry tool is a good solution.

SUMMARY OF THE INVENTION

A slip joint adjustable jaw pry tool is a plier type tool that grips a work piece internally, exerting force outward to hold a work piece or modify its' shape. As with a multitude of pliers, this tool is operated by hand manipulation. The jaws of the tool engage the interior surface of the work piece when the handles of the tool are squeezed toward each other. This action drives the jaws apart to meet the work. The proximity of the jaws to each other is determined by a slip joint tongue and groove mechanism traveling in a channel, which adjusts the location of the pivot point. This mechanism allows the tool to grip and pry a range of internal dimensions.

Figure 1:
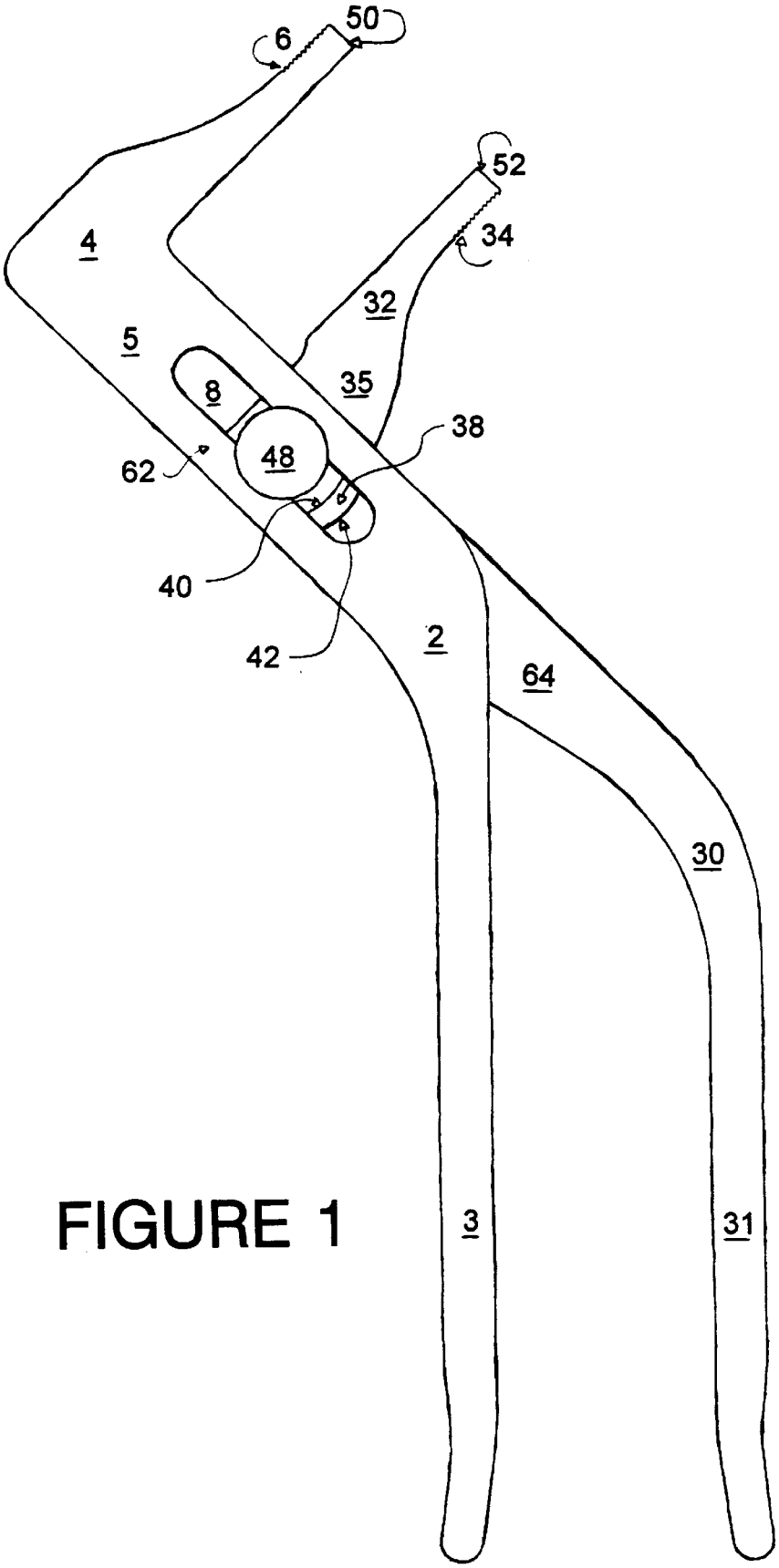
FIG. 1 illustrates a side elevation of a preferred embodiment of the device.
Figure 2:
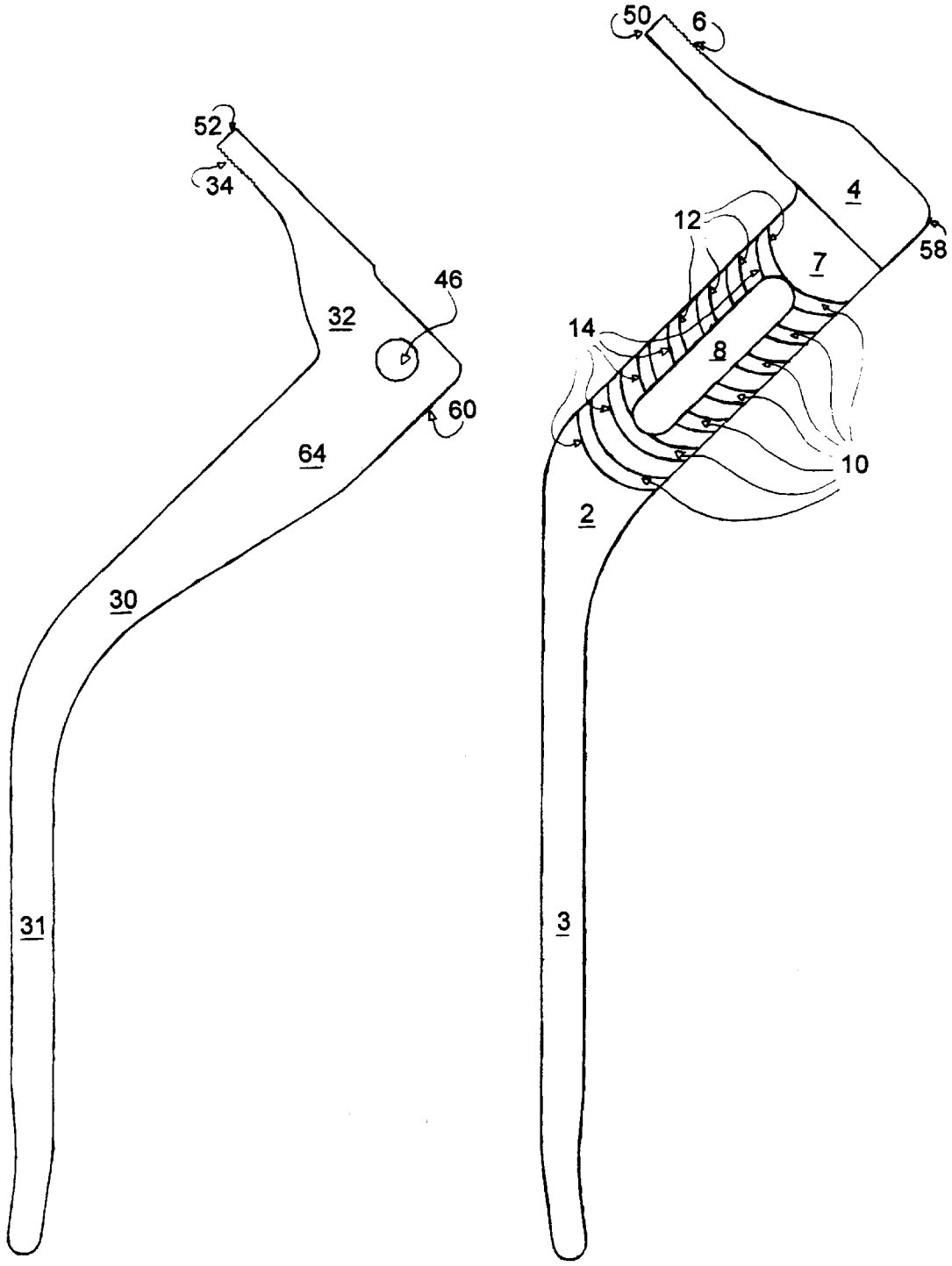
FIG. 2 illustrates the two lever components of this device exploded.
Figure 3:
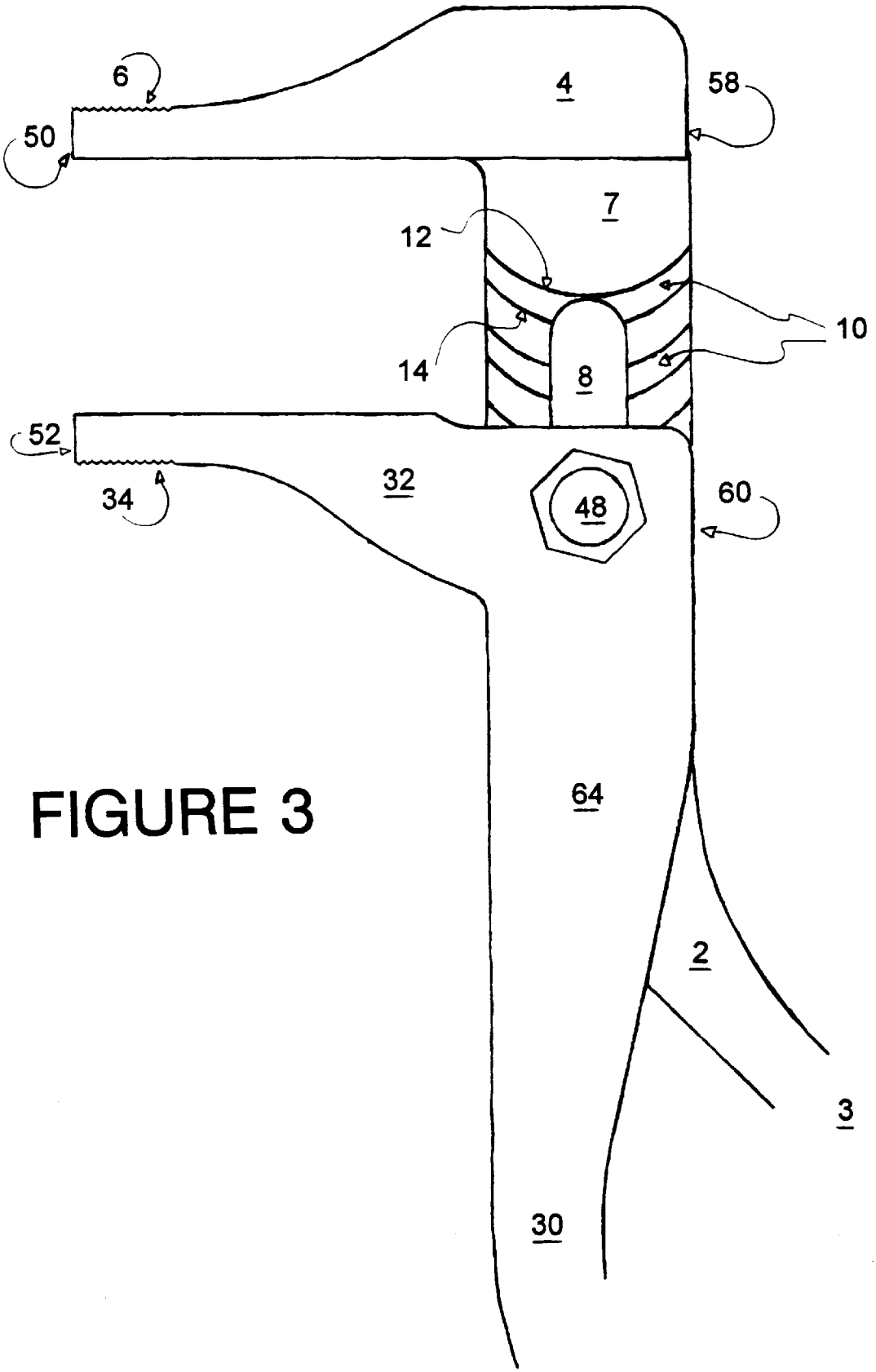
FIG. 3 illustrates the pivot means; interface of the arcuate protuberance and the arcuate grooves; and the jaws.

It is understood that there are other embodiments that fall within the scope and intent of this invention.

DESCRIPTION OF THE PREFERRED EMBODIMENT

The slip joint adjustable jaw pry tool illustrated according to the invention is shown to have a first lever 2 having a handle portion 3 and a jaw portion 4 with an outboard face 6. Between the handle portion 3 and jaw portion 4 a longitudinally disposed channel 8 extending from side 5 to side 7 which interfaces with a second lever described later in this text. The longitudinally disposed channel 8 is intersected by a plurality of arcuate grooves 10 on side 7 of the first lever, each having a convex side 12 and a concave side 14, with the concave side 14 of each arcuate groove facing the jaw portion 4, and the convex side 12 facing the handle portion 3.

The first lever is juxtaposed to a second lever 30 to articulate a prying device. The second lever 30 has a handle portion 31 and a jaw portion 32 with an outboard face 34. Provided between the handle portion 31 and jaw portion 32, and on side 35 that interfaces with the first lever on side 7, is an arcuate protuberance 38, having a concave side 40 and a convex side 42, the concave side facing the jaw portion 32, and the convex side 42 facing the handle portion 31. The arcuate protuberance 38 mates with any of the arcuate grooves 10 of the first lever. This juxtaposition provides a path and bearing for rotation about the axis of the attachment mechanism 48 described later in this text. A pivot center point 46 concentric with the arcuate protuberance 38 is provided on the second lever. The longitudinally disposed channel 8 of the first lever and the pivot center point 46 of the second lever is the location of the attachment mechanism 48. The attachment mechanism 48 juxtapositions the 2 levers to be articulated as a device. Attachment mechanism 48 secures the 2 levers loosely allowing rotation of either lever by hand manipulation, about the axis of the pivot center point 46, from a jaw tip 50 to jaw tip 52 contact position to a back of jaw 58 to back of jaw 60 contact position.

Although the orientations of jaws 4 and 32, and outboard faces 6 and 34 are germane to this invention, the specific shapes of these elements are not. The present invention has been described in some detail by way of illustrations for purposes of clarity and understanding, it will, of course, be understood that various changes and modifications may be made in the form, details, and arrangements of the parts without departing from the scope of the invention as set forth in the claims. The combination of levers 2 and 30 assembled with the attachment mechanism 48, forms an articulating device suitable for applying an expanding force. Pressing the 2 levers together by hand manipulation of the handle portions 3 and 31, results in the outboard faces 6 and 34 separating an incremental distance. The 2 levers may be rotated about the axis of the attachment mechanism 48, distancing jaw tip 50 from jaw tip 52 sufficiently to allow the arcuate proturberance 38 to disengage from a given arcuate groove 10. The second lever 30, along with the attachment mechanism 48, may then be moved to a different location in the longitudinally disposed channel 8 of the first lever 2 in order to engage a different arcuate groove 10, resulting in different working parameters for jaws 4 and 32.

I claim:

1. A pry tool comprising:

a. a first lever and a second lever, each including:
a handle portion;
an outboard facing jaw portion; and
a side that interfaces with the other lever;

b. the first lever is provided with a longitudinally disposed channel extending from the side that interfaces with the second lever to an opposing side; said longitudinally disposed channel is located between the handle portion and the jaw portion, said longitudinally disposed channel is intersected perpendicularly by a plurality of arcuate grooves on the side interfacing the second lever, said arcuate grooves have a concave side and a convex side, the concave side of each arcuate groove faces the jaw portion of the first lever, while the convex side of each arcuate groove faces the handle portion of the first lever;

c. the second lever is provided with:
a pivot center point means, that by attachment means, is confined to travel in a path defined by the channel of the first lever; and
an arcuate protuberance which has a concave side and a convex side, said concave side faces the jaw portion of the second lever and the convex side faces the handle portion of the second lever;
said arcuate protuberance selectively mates with any of the arcuate grooves on the first lever;
the pivot center point means and the arcuate protuberance are located on the second lever between the handle portion and the jaw portion on the interfacing side, with the pivot center point means located between the jaw portion and the arcuate protuberance, the arcuate protuberance is concentric to the pivot center point means;

d. the first lever and second lever are connected by an attachment means juxtapositioning the levers at the channel of the first lever and the pivot center point means of the second lever, joining the levers on their interfacing sides, and allowing rotation of the levers about the axis of the attachment means by hand manipulation.

* * * * *